US006071467A

United States Patent [19]

Paddock et al.

[11] Patent Number: 6,071,467

[45] Date of Patent: Jun. 6, 2000

[54] TECHNIQUE AND APPARATUS FOR LADLE CLEANOUT

[75] Inventors: John Paddock, Avon Lake; Fred H. Vandersluis, Vermilion; David J. Diederich, Avon Lake, all of Ohio

[73] Assignee: USS/Kobe Steel Company, Lorain, Ohio

[21] Appl. No.: 09/039,034

[22] Filed: Mar. 13, 1998

Related U.S. Application Data

[60] Provisional application No. 60/069,682, Dec. 12, 1997.

[51] Int. Cl.[7] ..... C21C 5/40

[52] U.S. Cl. ..... 266/158; 266/159; 266/144

[58] Field of Search ..... 266/158, 144, 266/159, 271

[56] References Cited

U.S. PATENT DOCUMENTS 3,013,789 12/1961 Sayre et al. ..... 266/158
3,380,371 4/1968 Scheel .
3,604,697 9/1971 Kawama et al. .
3,809,376 5/1974 Plazier .
4,050,367 9/1977 Eakes .
4,050,682 9/1977 Baum .
4,081,269 3/1978 Nomine et al. .
4,243,208 1/1981 Laimer .
4,256,289 3/1981 Neuner et al. .
4,379,548 4/1983 Boshoven .
4,460,389 7/1984 Baum et al. .
4,792,123 12/1988 Moser et al. .
4,836,510 6/1989 Weber et al. .

*Primary Examiner*—Scott Kastler
*Attorney, Agent, or Firm*—Fay, Sharpe, Fagan, Minnich & McKee, LLP

[57] ABSTRACT

An apparatus and technique for collecting fumes from a metallurgical vessel such as a ladle are disclosed. The apparatus and technique are particularly well suited for collecting fumes during a cleanout operation of one or more discharge ports along the bottom of the vessel when the vessel is inverted on its side.

4 Claims, 2 Drawing Sheets

TECHNIQUE AND APPARATUS FOR LADLE CLEANOUT

CROSS-REFERENCE TO RELATED APPLICATIONS

The present application claims priority from U.S. Provisional application Ser. No. 60/069,682, filed Dec. 12,1997.

BACKGROUND OF THE INVENTION

1. Field of the Invention

The present invention relates to a method and apparatus for collecting fumes from a metallurgical vessel, such as a ladle, undergoing a cleanout operation. Such cleanout operations are performed to remove solidified material from, or to unblock, one or more discharge ports in the vessel.

2. Description of the Related Art

Many large metallurgical vessels such as ladles have one or more openings or ports provided on their bottom for discharging material such as molten metal, from their interior. After emptying of molten metal, these vessels begin to cool, relatively rapidly, typically resulting in residual metal or slag within the bottom interior of the vessel solidifying and blocking the vessel discharge ports. A cleanout operation must then be performed to remove the solidified material from the one or more ports on the bottom of the vessel. In order to access the ports, the vessel is typically tipped onto its side.

Removing solidified material, e.g. metal or slag, from these ports is often performed by using a high temperature lance torch. The lance end of the torch is inserted into the blocked port as solidified material is melted and blown out of the port. The lance torch is inserted into the port from the exterior of the ladle and pushed inward toward, and eventually into, the ladle interior. As will be appreciated, copious amounts of fumes or smoke are generated. The fumes or smoke often comprise harmful or hazardous chemicals. During the initial phases of a cleanout operation, fumes and smoke are generated along the exterior bottom or underside of the tipped vessel. Once the torch has penetrated the previously blocked discharge port, and thus, a passage or opening is established within the port, fumes and smoke also flow from the bottom of the vessel, within its interior. In order to collect the fumes or smoke, it would be desirable to utilize a movable hood that could be positioned adjacent to the source of the fumes or smoke, and then be moved out of the way after such collecting.

Positionable or movable fume collecting hoods are known in the art. For example, U.S. Pat. No. 3,380,371 to Scheel describes a movable hood assembly for collecting fumes from a ladle as it is transported from one area in a plant to another area. Scheel notes that the hood assembly is designed for attachment to either the ladle or its supporting structure, thereby enabling the hood to travel along with the ladle. A flexible hose or duct enables movement of the hood.

Another approach to providing a positionable hood is described in U.S. Pat. No. 4,379,548 to Boshoven. Boshoven eliminates flexible hose sections and instead utilizes a series of swivelable duct sections essentially cantilevered from a stationary base to achieve mobility at the distal hooded section.

Although satisfactory in many respects, these hood configurations are generally not usable when attempting to collect fumes from a vessel or ladle oriented on its side. Accordingly, there is a need for a movable hood and duct assembly for collecting fumes from a vessel oriented on its side. Moreover, there is a need for a system of collecting fumes emitted during a ladle cleanout operation which is often characterized by the emission of fumes and smoke along the bottom exterior of the ladle, followed by emission within the ladle interior.

SUMMARY OF THE INVENTION

The present invention achieves the foregoing objectives and provides, in a first aspect, a system for collecting fumes during a cleanout operation performed upon a metallurgical vessel. The system comprises a primary hood adapted to engage an open end of the vessel. The system also comprises a secondary hood for placement near the other end of the vessel and near a port in the vessel in need of unblocking or cleaning. The system further comprises an air handling assembly in communication with the primary and secondary hoods. Upon operation of the air handling system, any fumes in or around the vessel are drawn into and collected by the primary and secondary hoods.

In yet another aspect, the present invention provides an apparatus for collecting airborne materials during a cleanout operation of a ladle. The apparatus comprises a primary hood including a support frame and enclosure. The primary hood further includes a receiving wall adapted to engage an open end of the ladle. The apparatus further comprises a primary duct assembly including a receiving plenum engageable with the primary hood and a discharge duct in communication with the receiving plenum. The apparatus further includes a secondary hood for placement near the ladle port in need of cleaning. The secondary hood includes an intake plenum and a discharge duct. The apparatus also comprises at least one air handling system in communication with the primary and secondary hoods.

And, in another embodiment, the present invention includes a method of collecting fumes, smoke, and gases during cleanout of a blocked discharge port along the bottom of a ladle. The method comprises providing a first and a second hood, both connected to at least one air handling assembly, and engaging the first hood over and generally covering an open end of the ladle. The second hood is then positioned near the discharge port. The air handling assembly is operated to draw air within the interior of the ladle, and air near the discharge port, into the first and second hoods, respectively.

DESCRIPTION OF THE PREFERRED EMBODIMENTS

Figure 1:
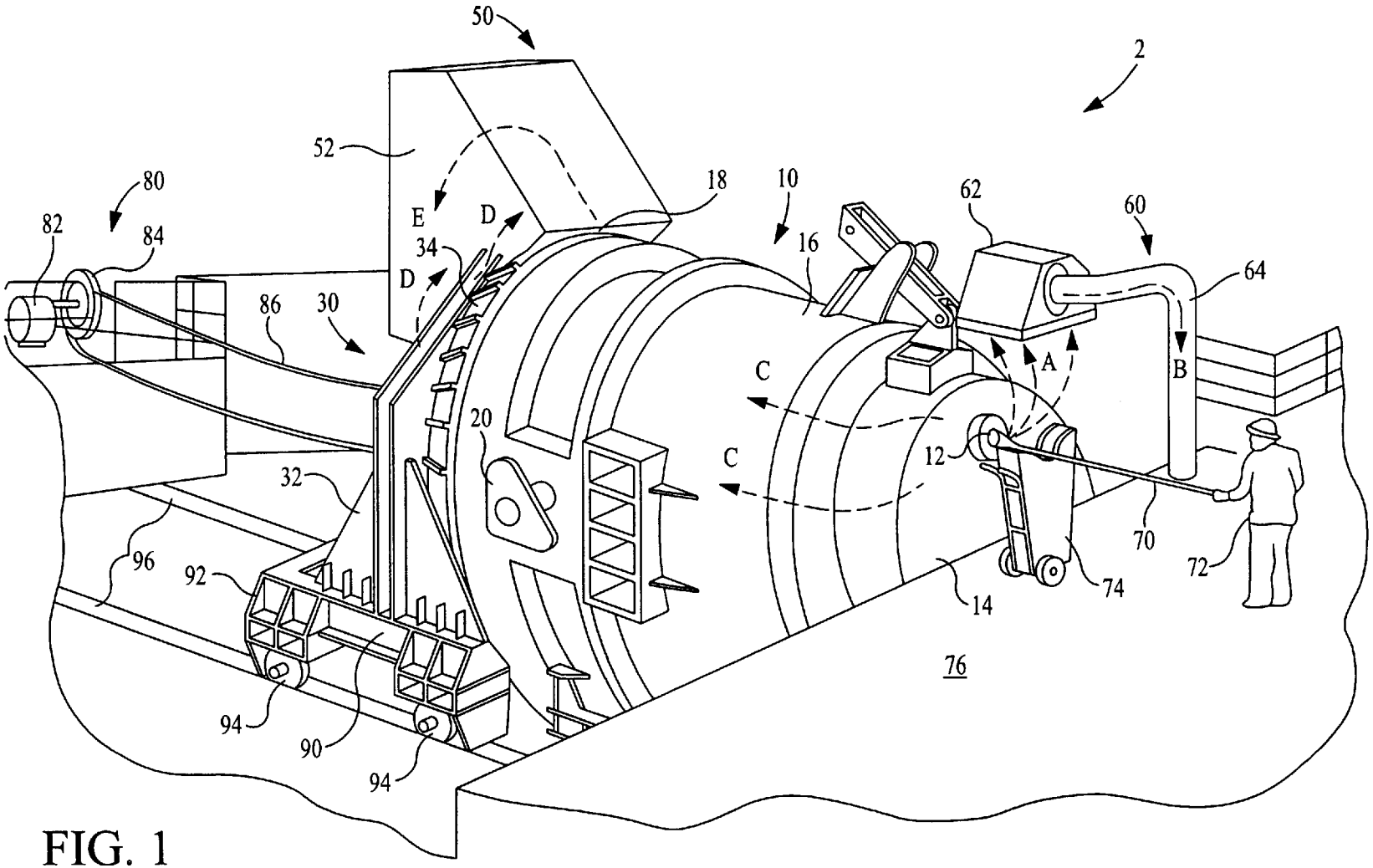
FIG. 1 is a perspective view of a preferred embodiment ladle cleanout system in accordance with the present invention.

FIG. 1 illustrates a preferred embodiment ladle cleanout system 2 in accordance with the present invention. The preferred embodiment system 2 is particularly adapted for collecting fumes, smoke, and gases emitted from a cleanout operation performed upon a ladle, such as the ladle 10 illustrated in FIG. 1. As previously noted, prior to performing a cleanout operation, the vessel or ladle in need of cleanout is oriented onto its side and position within the system 2 as described in greater detail below. The preferred embodiment system 2 comprises a primary hood 30 that engages an upper portion of the ladle 10, a primary duct assembly 50 that may be selectively coupled to the primary hood 30, a secondary hood 60 for placement near the bottom of the ladle 10, and a transport assembly 80 and a primary hood cart 90 that enables the primary hood 30 to be selectively positioned with respect to the ladle 10 and the secondary hood 60.

A wide array of metallurgical vessels may be used with the preferred embodiment cleanout system 2. The preferred embodiment system 2 is particularly well suited for a cleanout operation of a ladle 10 as shown in FIG. 1. The ladle 10 includes a side wall 16 extending between a bottom or floor 14 and an upper rim 18 that defines an opening allowing access to the ladle interior. The ladle 10 is typically circular or oval in cross-section, and so the side wall 16 is circumferential or arcuate in at least some regions. The ladle 10 further includes one or more discharge ports 12 defined along the ladle floor 14. It is these discharge ports 12 that become blocked with solidified material or slag and so, require cleanout. The ladle 10 may further include one or more fixtures 20 provided along the exterior of the ladle 10. The fixtures 20 promote gripping or manipulating of the ladle 10 such as when placing it on its side.

Figure 2:
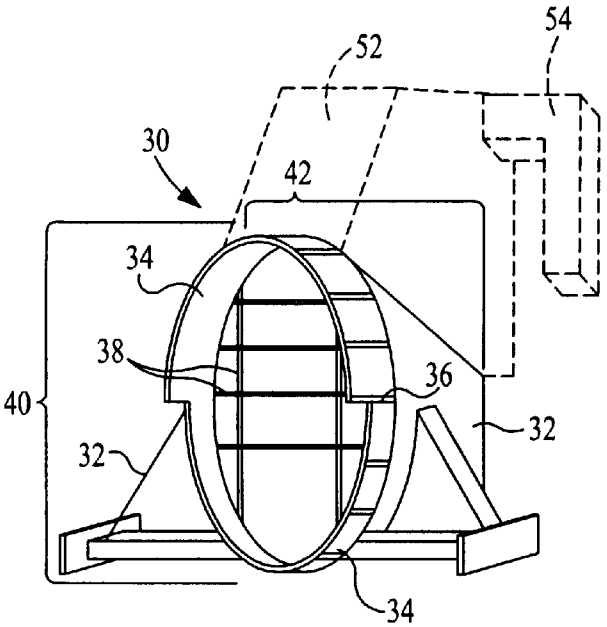
FIG. 2 is a simplified view of a preferred embodiment primary hood in accordance with the present invention.

The primary hood 30 is adapted to engage, and preferably, fit over, the open face of the ladle 10. Most preferably, the primary hood 30 sealingly receives an upper portion, such as the rim 18, of the ladle 10. The primary hood 30 comprises a receiving wall 34 adapted to engage the vessel or ladle 10, and a support frame 32 generally forming the body and enclosure of the primary hood 30. It is most preferred that the receiving wall 34 include a sufficient amount of heat resistant material or thermal insulating material along its interior or inwardly facing surface. This provides protection from the relatively high temperatures in the event the ladle 10 has not yet fully cooled to ambient temperature. Moreover, such material may also serve as a sealing material and promote sealing between the primary hood 30 and the ladle 10. As best shown in FIG. 2, the receiving wall 34 extends around and defines an intake region 40, through which fumes, smoke, or gases are collected from the open end of the ladle 10. A grate 38 or screened member preferably extends across the intake region 40. The primary hood 30 also provides an exhaust region 42 preferably provided along its upper portion. The support frame 32 generally defines the exhaust region 42. Fumes, smoke, or gases collected from the ladle 10 and drawn into the primary hood 30 exit from the hood 30 through the exhaust region 42. This and details of the gas flows are described in greater detail below.

The ladle cleanout system 2 comprises a primary duct assembly 50 that engages the primary hood 30, preferably at the exhaust region 42 of the hood 30. The primary duct assembly 50 serves to collect fumes, gases, and smoke collected from the primary hood 30, and direct such to a baghouse, filtering component, or other processing unit. The primary duct assembly 50 comprises a receiving plenum 52 that is adapted to engage with, and preferably sealingly mate with, the exhaust region 42 of the primary hood 30. The primary duct assembly 50 further comprises a discharge duct 54 that directs and confines the collected fumes, gases, and smoke away from the receiving plenum 52.

An air handling assembly (not shown) is preferably disposed downstream and in communication with the discharge duct 54. The air handling assembly creates a pressure differential and creates a moving air flow from the intake region 40 of the primary hood 30, through the hood 30, out of the exhaust region 42 of the hood 30, into the receiving plenum 52 of the primary duct assembly 50, and through the discharge duct 54. The air handling system preferably comprises a blower or fan assembly as known in the art, powered by a motor and geared drive.

It is particularly preferred that the primary hood 30 be easily movable. Since the primary hood 30 is desirably closely engaged with the open end of the ladle 10, upon proper positioning and orientation of the ladle 10 described in greater detail below, the movability feature of the primary hood 30 enables it to be moved into engagement with the ladle 10 once properly positioned. Accordingly, the ladle cleanout system 2 preferably comprises a primary hood cart 90. The cart 90 is used in conjunction with the primary hood 30 and allows the hood 30 to be easily moved from one location to another. A preferred primary hood cart 90 comprises a support frame 92, a plurality of wheels 94, and a support surface upon which is disposed the primary hood 30. As shown in FIG. 1, it is most preferred to utilize a pair of tracks 96 within which the wheels 94 or rollers of the cart 90 move. The present invention includes a variant embodiment in which the primary hood 30 and the primary hood cart 90 are combined in one integral unit.

The preferred embodiment ladle cleanout system 2 may further comprise a transport assembly 80 for moving the primary hood cart 90 and/or the primary hood 30. The transport assembly 80 may take various forms. One preferred form is to utilize a motor 82, a drive unit 84, and a cable or chain assembly 86 that attaches to a stationary base and the primary hood 30 and/or the primary hood cart 90. As will be appreciated, and as described in greater detail below, upon operation of the motor 82, the primary hood 30 is pulled toward the transport assembly 80. It is to be understood that the present invention includes an embodiment in which the transport assembly is disposed on the primary hood cart 90 and/or the primary hood 30. In this latter embodiment, the transport assembly is preferably an engine and drive assembly as known in the art that provides rotational power to one or more wheels, such as the wheels 94, of the primary hood 30 and/or the cart 90.

It is preferred that the primary duct assembly 50 be separate from the movable primary hood 30. It is also preferable that the primary duct assembly 50 be movable or positionable. However, it is not necessary that the primary duct assembly 50 be movable to the same extent as the primary hood 30. In a most preferred configuration, the primary hood 30 is freely movable, such as by use of the primary hood cart 90 and the transport assembly 80, so that the primary hood 30 can be brought into approximate or near engagement with the primary duct assembly 50. Then, the assembly 50, and particularly the receiving plenum 52, is positioned into engagement with the exhaust region 42 of the primary hood 30. This configuration enables easy and quick coupling between the fume collecting provisions and an open end or top, of a metallurgical vessel such as ladle 10.

The ladle cleanout system 2 further comprises a secondary hood 60 disposed at a location at which the bottom or floor 14 of the ladle 10 may be accessed during a cleaning operation. The secondary hood 60 includes an intake plenum 62 and a discharge duct 64 for collecting fumes, smoke and gases existing or emitted around the bottom or floor 14 of the ladle 10 during a cleanout operation. The secondary hood 60 is preferably movable such that the intake plenum 62 may be moved into close proximity with the ladle 10 and particularly the one or more discharge ports 12 undergoing cleaning or unblocking.

An air handling assembly (not shown) is preferably disposed downstream and in communication with the discharge duct 64. The air 30 handling assembly creates a pressure differential and creates a moving air flow from the intake plenum 62 through the discharge duct 64. The air handling system preferably comprises a blower or fan assembly as known in the art, powered by a motor and geared drive. A single or common air handling assembly may be used in some applications to draw air through both the primary hood 30 and the secondary hood 60.

FIG. 2 is a perspective view of the preferred embodiment primary hood 30 and its engagement with the primary duct assembly 50 shown in phantom. FIG. 2 illustrates the grate 38 or screened member that preferably extends over the intake region 40 of the hood 30. FIG. 2 also illustrates that the intake region 40, i.e. the preferred region of the hood 30 that engages the open end of a ladle, has the same shape or configuration as the open end of the ladle to which the primary hood 30 engages. FIG. 2 illustrates the intake region 40 having a slightly oval shape as the ladle 10 has an oval cross-section. It is also contemplated to provide a plurality of slotted apertures 36 around the intake region 40, and preferably within the receiving wall 34. In the event that the primary hood 30 is engaged relatively tightly or sealingly to the open face or end of the ladle 10, upon operation of the air handling assembly in communication with the primary duct assembly 50 and the primary hood 30, air may be drawn into the primary hood 30 to prevent an excessive pressure differential from developing.

Figure 3:
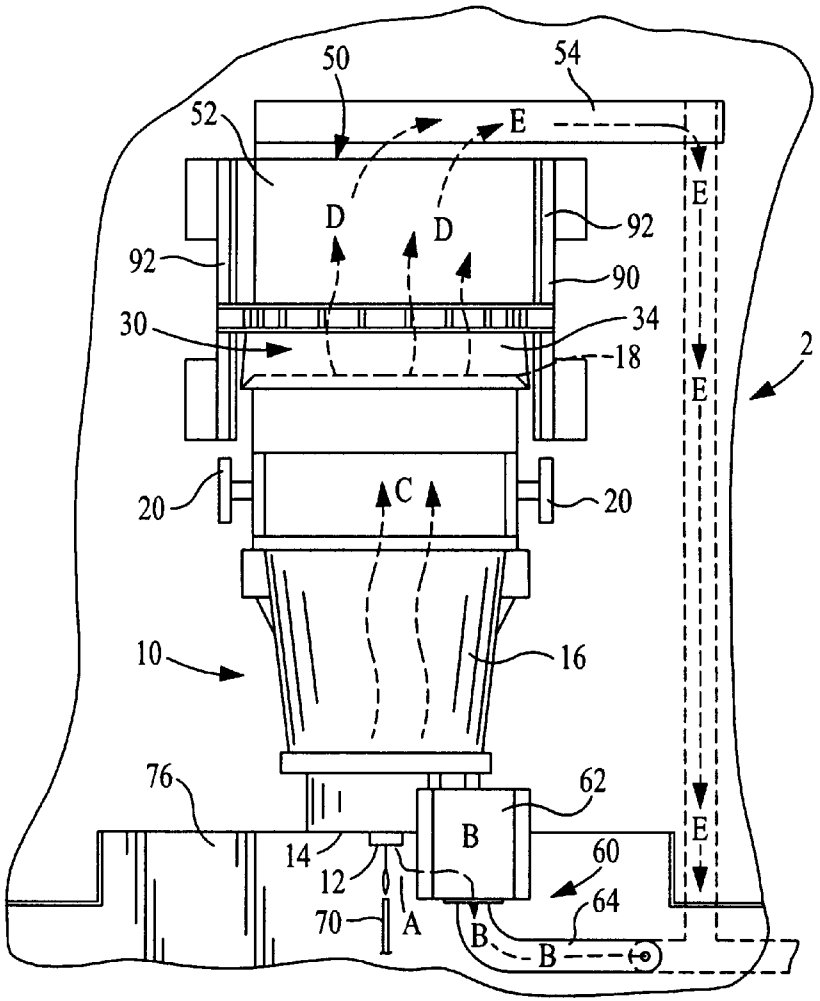
FIG. 3 is a plan view of the preferred embodiment ladle cleanout system shown in FIG. 1.

FIG. 3 best illustrates a preferred gas flow routing configuration utilized in the preferred embodiment ladle cleanout system 2. Upon proper positioning and orientation of a ladle, such as placing the ladle 10 on its side, the one or more air handling systems are operated. As cleanout of one or more blocked discharge ports 12 is initiated along the exterior of the ladle floor 14 or bottom, fumes, smoke, and other gases are generated. These are collected and drawn into the secondary hood 60 and shown as air flow A. Once having entered the intake plenum 62 of the secondary hood 60, the collected fumes, smoke, and gases are drawn into and through the discharge duct 64 for subsequent processing, treatment, or filtering. This is illustrated as air flow B. As the cleaning and unblocking of discharge ports 12 progresses, fumes, smoke, and gases are increasingly emitted from within the interior of the vessel or ladle 10. Once a passageway has been fully formed within a discharge port 12, i.e. the port 12 is unblocked, the amount of fumes or smoke emission into the ladle interior may greatly increase. Collection and removal of fumes, smoke and gases from the interior of the ladle 10 results in air flow C toward the primary hood 30. Once the collected flows enter the primary hood 30, they travel toward the exhaust region 42 of the hood 30 as air flow D. The collected fumes, smoke, and gases are then drawn into the discharge duct 54 of the primary duct assembly 50 as air flow E for subsequent processing, treatment, or filtering. As depicted in FIG. 3, the air flows E and B may be merged together.

Although the preferred embodiment ladle cleanout system 2 has been described in terms of a cleaning operation performed upon a ladle oriented upon its side, the present invention system could be used in a wide array of cleaning techniques. For example, the present system could be utilized during a cleanout operation performed upon a vertically oriented upright ladle. The primary hood 30 could be supported at a location proximate the upwardly facing open top of the ladle. The secondary hood 60 would be disposed near the ladle bottom. However, this arrangement is not as preferred as that depicted in FIGS. 1 and 3 since, as best shown in FIG. 3, fumes are most easily and readily collected when the secondary hood 60 may be positioned directly above the particular discharge port 12 undergoing cleaning.

The one or more discharge ports 12 along the bottom of the ladle 10 are preferably cleaned as follows. Once the ladle 10 is properly positioned and in place for cleaning before an elevated station 76, such as shown in FIGS. 1 and 3, an operator 72 identifies the discharge port 12 in need of cleaning or unblocking. A wheeled support 74 is positioned in front of the port 12 to be cleaned. The air handling system(s) are operated, or if already running, a confirmation of their operation is made. A high temperature cutting torch or lance 70 is then used to melt and remove metal, slag, or other residual matter from the port 12. Typically, in unblocking a plugged port 12, a passageway is formed within the port extending from the exterior of the ladle floor 14, to the interior face of the ladle floor 14. The copious amounts of gaseous products emitted from and during cleanout are collected by the primary hood 30 and the secondary hood 60.

The invention has been described with reference to the preferred embodiments. Obviously, modifications and alterations will occur to others upon a reading and understanding the preceding detailed description. It is intended that the invention be construed as including all such modifications and alterations in so far as they come within the scope of the appended claims or the equivalents thereof.

What is claimed is:

1. A system for collecting fumes emitted during a cleanout operation of a metallurgical vessel having a first open end providing access to the interior of the vessel, and a second closed end defining at least one blocked port in need of cleaning, said system comprising:

a primary hood adapted to engage said open end of said vessel, a secondary hood for placement proximate to said second end of said vessel and said port defined in said second end;

a primary hood cart upon which is disposed said primary hood, wherein said cart facilitates movement of said hood;

a transport assembly affixed to a stationary base, said transport assembly including (i) a motor, (ii) a drive unit coupled to and powered by said motor, and (iii) a cable or chain assembly retractable by operation of said motor and said drive unit, wherein said cable or chain assembly is selectively engageable to at least one of said primary hood and said primary hood cart; and at least one air handling assembly in communication with said primary hood and said secondary hood, wherein upon operation of said air handling assembly, said fumes emitted during said cleanout operation of said vessel are collected by said primary hood and said secondary hood.

2. A method of collecting fumes, smoke, and gases during cleanout of a blocked discharge port in a ladle, said ladle having a first open end providing access to an interior region of said ladle, and a second closed end at which is defined said discharge port, said method comprising:

providing a first hood, a second hood, and at least one air handling assembly, said first and second hoods being in communication with said at least one air handling assembly;

engaging said first hood over and generally covering said open end of said ladle;

positioning said second hood proximate to said discharge port; and operating said at least one air handling assembly whereby air within said interior region of said ladle is drawn into said first hood and air proximate to said discharge port is drawn into said second hood.

3. The method of claim 2 further comprising:

unblocking said discharge port.

4. The method of claim 3 wherein said unblocking step is performed with a cutting torch inserted within said discharge port whereby fumes, smoke, and gases are emitted and subsequently collected by said first and second hoods.

* * * * *